US011111674B1

(12) United States Patent
Kanawyer

(10) Patent No.: US 11,111,674 B1
(45) Date of Patent: Sep. 7, 2021

(54) EXTENDED ROOF TRUSS WITH OUTBOARD PURLINS HAVING LOAD SUPPORTING K-TRUSSES AT EXTENSIONS

(71) Applicant: Don Kanawyer, Santa Clara, CA (US)

(72) Inventor: Don Kanawyer, Santa Clara, CA (US)

( * ) Notice: Subject to any disclaimer, the term of this patent is extended or adjusted under 35 U.S.C. 154(b) by 16 days.

(21) Appl. No.: 16/791,883

(22) Filed: Feb. 14, 2020

(51) Int. Cl.
*E04C 3/02* (2006.01)

(52) U.S. Cl.
CPC ..... *E04C 3/02* (2013.01); *E04C 2003/026* (2013.01)

(58) Field of Classification Search
CPC ..... E04C 3/02; E04C 2003/026
USPC ..... 52/90.1, 633, 636, 639, 690, 693
See application file for complete search history.

(56) References Cited

U.S. PATENT DOCUMENTS 1,360,509 A * 11/1920 Eleman ..... E04C 3/42 52/644
1,793,188 A * 2/1931 Noerenberg ..... E04B 1/24 52/262
3,019,861 A 3/1959 Rasch et al.
3,760,550 A * 9/1973 Mueller ..... E04C 3/005 52/641
4,649,688 A * 3/1987 Mosier ..... E04B 1/2604 14/9
6,430,887 B1 * 8/2002 Daudet ..... E04B 1/3441 16/223
6,634,152 B1 * 10/2003 Pilkinton ..... E04C 3/005 52/641
9,366,027 B2 * 6/2016 Martigli ..... E04B 7/024
2014/0373481 A1 * 12/2014 Martigli ..... E04C 3/17 52/643

FOREIGN PATENT DOCUMENTS

GB 2214944 A * 9/1989 ..... E04C 3/17
JP 01192941 A * 8/1989

OTHER PUBLICATIONS

Marks' Standard Handbook for Mechanical Engineers, by E. Avallone et al., 9th Ed. 1987, p. 12-16.

* cited by examiner

*Primary Examiner* — Brent W Herring

(57) ABSTRACT

A roof truss having laterally extended portions compared to standard size roof trusses for supporting a roof over a longer span compared to the span of a standard size truss. The extended portion has a supplemental purlin outside of the outermost web member of a standard size roof truss. The supplemental purlin transmits roof load force through a K truss or half-K truss with the upper portion of the K truss fastened to the supplemental purlin and a lower portion fastened to the roof truss extended bottom chord. Use of the supplemental purlin and K-truss architecture eliminates the need for sloping web members in the truss extended portion thereby saving material in truss construction while utilizing standard size truss templates and assembly jigs.

4 Claims, 2 Drawing Sheets

EXTENDED ROOF TRUSS WITH OUTBOARD PURLINS HAVING LOAD SUPPORTING K-TRUSSES AT EXTENSIONS

TECHNICAL FIELD

The invention relates, in general, to roof trusses, and, specifically to a truss architecture for increased truss span compared to standard truss design.

BACKGROUND ART

In construction of pitched roofs where spaced apart trusses are used in place of beams for long spans, the load on a roof of a building is supported with a plurality of trusses spaced apart along the axis or length of the building. Each truss has upper sloping top chords meeting at a roof peak and a horizontal bottom chord below the top chords and with web members that interconnect top roof chords to the bottom roof chord. Web members are usually diagonal to the horizontal bottom chord but can be upright, but with top and bottom chords and web members all lying in a common plane. Identical roof trusses are spaced apart along the length of the building for roof support. An example of prior art standard roof trusses may be seen in "Mark's Standard Handbook for Mechanical Engineers" by E. Avallone et al., $9^{th}$ Ed. 1987, p. 12-16, incorporated by reference herein.

Most roofs are framed with a plurality of trusses that are pre-fabricated to specified sizes. At the pre-fabrication site assembly jigs or specified patterns are used for standard size truss construction. Structural engineering loads are taken into consideration for the patterns that are then considered to be appropriate for a particular project, building or development.

A problem that arises in construction is that sometimes an architect, owner or builder will specify slightly larger roof trusses than a standard pattern that is usually used by the manufacturer. For example, a standard roof truss span of a manufacturer might be 50 feet and an architect, owner or builder specifies a span of 60 feet or 70 feet, i.e. 5 or 10 feet greater on each side, amounting to 10% to 20% greater. A standard approach would be to design a new truss for the greater span with added web members to support a larger roof, or to do nothing if the span extension were small.

An object of the invention is to extend the span of standard roof trusses while using a standard roof truss design with added roof support but without adding more web members that would use substantial amounts of material in multiple identical trusses.

SUMMARY DISCLOSURE

The present invention, termed a Kanawyer extended truss, extends the span of common standard roof trusses of diverse manufacturers by a small amount, not more than 20% of the span, without using more web members. This is achieved by adding a purlin outside of the outermost web member of the extended standard span size common truss having an extended horizontal bottom chord and at least one sloping top chord over the extended bottom chord at about the midpoint of the top chord extended region that is beyond the furthest extent of a web member contacting the top chord. This purlin is termed an outboard purlin. In turn, the new outboard purlin transmits downward roof loading onto back-to-back K-trusses vertically disposed and fastened to the bottom chord with a tie where they are supported with loading transmitted to the bottom chords through the K-truss. The ends of the bottom chord are fastened to spaced apart upright beams of the building that define the roof span. Each K-truss may be a full K truss with one vertical member and two inclined members or preferably a half-K truss having one vertical member and one inclined member, with the upper part of the K fastened to the new purlin and to a post between back-to-back K-trusses. The back-to-back K-trusses are inward of the outermost span edge of trusses and provide load support for the top chord extension without the need for additional diagonal or vertical web members between the top and bottom chords.

DETAILED DESCRIPTION

Figure 1:
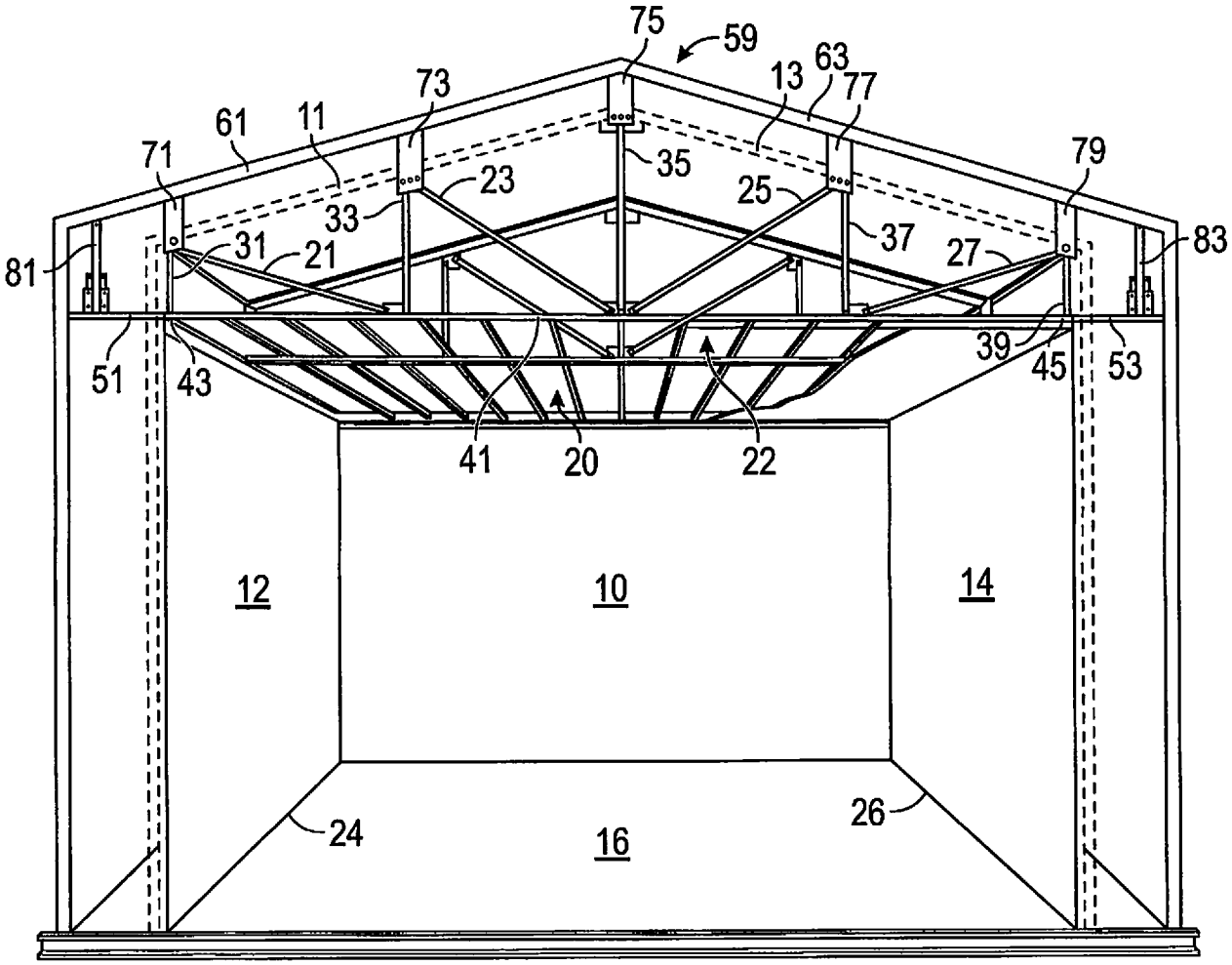
FIG. 1 is a perspective construction view of a roof truss of the invention for a building having an extended span compared to a standard roof truss.

With reference to FIG. 1, a building having a standard size roof is illustrated by dashed lines in FIG. 1, resembling the building construction illustrated in FIG. 1 of U.S. Pat. No. 1,793,188 to C. Noerenberg, incorporated by reference herein. The building has a back wall 10, side walls 12 and 14, a floor 16, and a roof 59 that is supported by a plurality of planar, spaced apart standard size roof trusses, such as truss 20 in the background and truss 22 in the foreground, plus others not shown. The plane of the roof trusses is perpendicular to the lengthwise axis of the building which is one or more parallel lines running down the length of the building, such as lines 24 and 26. The building has a sloped or pitched roof 59 supported by roof trusses with sloped top chords illustrated by dashed lines 11 and 13 where sloping top chords of a standard size truss reside.

A standard size truss has sloping web members 21, 23, 25, and 27, along with vertical web members 31, 33, 35, 37, and 39, all supported from below by the bottom chord 41 having ends at end regions 43 and 45. Such standard sizes for trusses are standard because they are manufactured using assembly jigs or floor patterns where web member boards and chords are fit upon grooves or set onto a template and then fastened in place for shipping.

Figure 2:
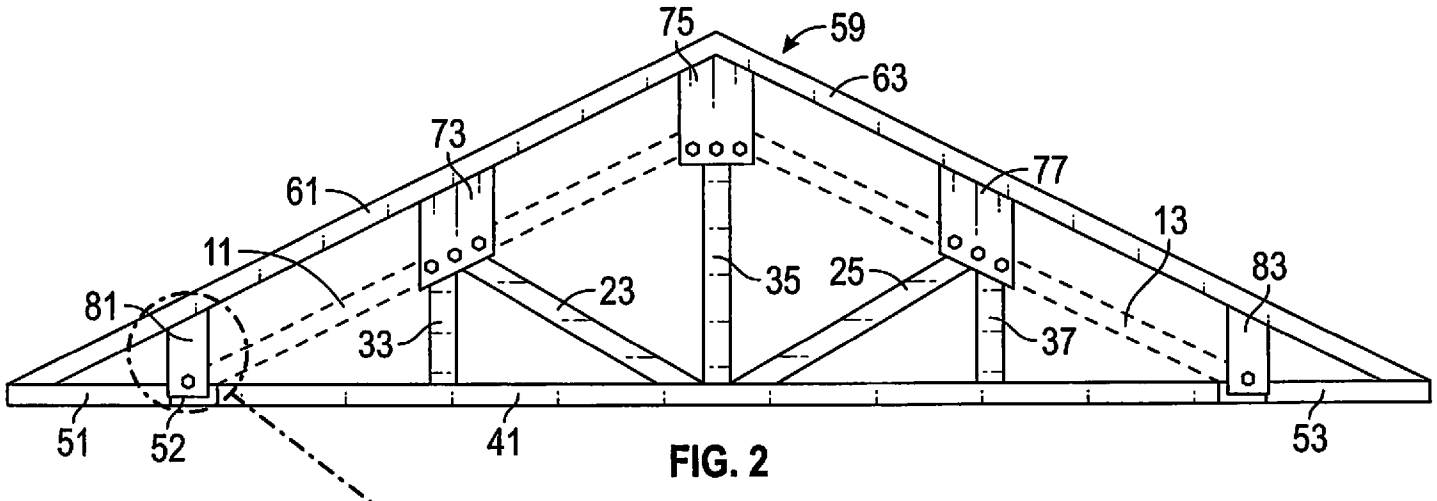
FIG. 2 is a front plan view of another roof truss having an extended span of the invention.

In FIGS. 1 and 2, an expanded truss is shown using the framework of a planar standard truss. Expansion occurs with bottom chord extensions 51 and 53 that are fastened to end regions 43 and 45 respectively of bottom chord 41, extending the bottom chord by no more than between 10% to 20% of the chord length. For a standard size roof truss span of 50 feet, a span of 60 feet or 70 feet could be specified by a building architect. For an extended span of 60 feet, the standard 50 foot span would have opposite laterally extended regions 51 and 53 of 5 feet each for a total extension of 10 feet. For an extended span of 70 feet, the standard 50 foot span would have laterally extended regions 51 and 53 of 10 feet each for a total roof span extension of 20 feet. Note that in the above laterally extended span regions 51 and 53 there are no sloping web members in the plane of the truss. This holds true so long as the laterally extended regions are not more than 20% of the length of the bottom chord 41. Beyond 20% structural engineers would probably specify additional sloping web members using calculations such as those found in Mark's Mechanical Engineering Handbook, referenced above, but there are no sloping web members in the laterally extended span regions in the truss plane of the invention.

Since bottom chord 41 is longer, a longer roof 59 can be supported with longer top chords 61 and 63 of the roof truss. The web chords 31 and 21 that are not in the extended truss region are tied at top ends to the bottom edge of a purlin 71 that extends perpendicular to the plane of the roof truss. Purlin 71 may be a two inch by six inch piece of lumber that supports the outermost region of truss top chord 61 on its top edge and runs the length of the roof to the back wall 10. Similarly, purlins 73, 75, 77, and 79 are parallel to purlin 71. On a top edge of each purlin support truss top chords 61 and 63 of the extended roof truss are fastened. The opposite downward purlin edges are fastened to web members that are in place at locations of a standard size roof truss. Only the top and bottom chords of the new roof truss are extended. Web members are the same, supplemented by a pair of opposed supplemental purlins 81 and 83 that are associated with K-trusses, or half-K trusses, that are situated in a plane perpendicular to the roof truss plane. A K-truss has a single upright member and sloping side members as in the letter K. A half-K truss has only the upper sloping member. Back-to-back K or half-K trusses share the single upright member. Support post 81 hides a purlin that is laterally outboard of outermost purlin 71 of a standard truss on one side, while support post 83, hiding another purlin, is laterally outboard of outermost purlin 79 on the opposite side. The support posts may be two inch by six or eight or twelve inch boards located near the midpoint of the top chord extended region. The phrase "near the midpoint" means between one and one-half feet (18 inches) on either side of the midpoint of the extended region of the new roof truss.

Figure 3:
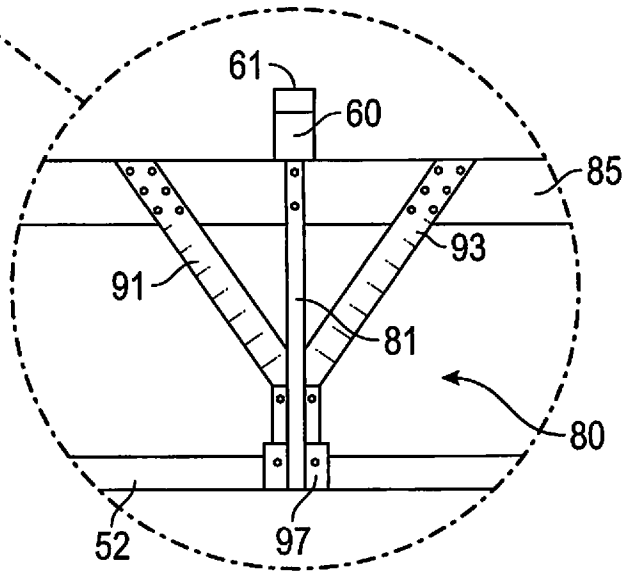
FIG. 3 is a side view of a K-truss support structure for the extended span of FIG. 2, having a plane perpendicular to the plane of the extended span region shown in FIG. 2 located in the circled region of FIG. 2.

In FIG. 3, half-K trusses 80 and 82 are in the interior of a building, not at its ends, since FIG. 3 shows back-to-back half-K trusses. A supplemental purlin 85, hidden in FIG. 2, is seen in FIG. 3 as providing support to K-truss upper members 91 and 93 at their upper extremities, while lower extremities are fastened to support post 81 using ties 95 and 97. The supplemental purlin 85 runs parallel to and spaced apart from other purlins 73, 75 and 77 in FIG. 2. Lower tie 97 is fastened to bottom chord extension brace 52 that is anchored to bottom chord extension 51. The supplemental purlin 85 is connected to block 60 that makes contact with support truss top chord 61. Loads on the extended portion of the roof are transmitted from the roof portion through the support truss sloping chord 61 to block 60 and onto supplemental purlin 85, then to the back-to-back half-K trusses 80 and 82 and onto bottom truss chord 51 in FIG. 2. At ends of the building, only a single half-K truss is used with the upper member of the half-K truss pointing into the building. As an alternative to half-K trusses, regular K trusses could be substituted anchored at the lowermost portion to the bottom truss chord 51. In this manner, standard size truss fabrication tools and frameworks may be used to fabricate extended roof trusses now known as a Kanawyer extended truss for roofs over greater spans than standard size roofs.

What is claimed is:

1. An oversize roof truss for roof support comprising:

a truss bottom chord extending beyond the span of a standard size bottom chord of a standard size roof truss by no more than twenty percent of the standard bottom chord lengthwise dimension, thereby defining an elongated truss bottom chord, the elongated truss bottom chord having opposed ends connected to spaced apart upright beams that define an elongated roof span for truss support from below that is beyond the span of a standard size roof truss;

a pair of truss top chords meeting at a roof peak and extending laterally over the elongated truss bottom chord creating elongated truss top regions for roof support;

a plurality of web members between the truss bottom chord and the truss top chords within the span of the standard size bottom chord, the web members completely supporting the elongated roof span for truss support from below wherein an outer end of each truss top chord is directly supported from below by the truss bottom chord, the elongated truss top chords and elongated truss bottom chord all in a common plane, the web members fastened to purlins that run between spaced apart roof trusses perpendicular to the common plane;

a pair of spaced apart supplemental purlins in the elongated truss regions providing roof support by elongated truss connection of elongated truss bottom chords to truss top chords in elongated truss regions; and a full or half-K truss connecting each supplemental purlin to the truss bottom chord thereby transferring roof loads in the elongated truss regions to the bottom truss chord.

2. The apparatus of claim 1 wherein the web members include sloping and vertical members.

3. The apparatus of claim 1 wherein the standard span dimension of a truss manufacturer is defined by mass produced trusses of the manufacturer.

4. The apparatus of claim 1 wherein the supplemental purlin connects a plurality of identical extended truss regions of identical spaced apart roof trusses.

* * * * *